United States Patent [19]

Norman et al.

[11] Patent Number: 4,924,660

[45] Date of Patent: May 15, 1990

[54] ADJUSTABLE STIRRUP BAR

[75] Inventors: Dennis L. Norman; Melvin E. Norman, both of Battle Creek, Mich.

[73] Assignee: Whitman Saddle Mfg., Inc., Battle Creek, Mich.

[21] Appl. No.: 302,433

[22] Filed: Jan. 26, 1989

[51] Int. Cl.[5] ..... B68C 1/16

[52] U.S. Cl. ..... 54/46

[58] Field of Search ..... 54/23, 44, 46

[56] References Cited

U.S. PATENT DOCUMENTS

| | | | |
|---|---|---|---|
| 340,044 | 12/1861 | Eagle | 54/46 |
| 474,715 | 5/1892 | Bailey | 54/46 |
| 2,739,434 | 3/1956 | Bell | 54/46 |
| 4,782,649 | 11/1988 | Zubrod | 54/46 |

OTHER PUBLICATIONS

Photocopy of Conventional Adjustable Stirrup Bar.
Midwest Saddlery Company Catalog.
Photocopies of pp. 2, 4, 8 and 16 of the Midwest Saddlery Company Catalog.

*Primary Examiner*—Robert P. Swiatek
*Attorney, Agent, or Firm*—Flynn, Thiel, Boutell & Tanis

[57] ABSTRACT

An adjustable stirrup bar for a saddle includes an elongate member having first and second ends, and a stirrup hanger for pendently supporting a stirrup strap, the stirrup hanger being mounted on the elongate member. A transport unit is cooperable with the stirrup hanger for moving the stirrup hanger longitudinally on the elongate member. A locking unit is operable for locking the stirrup hanger at any location on the elongate member. A mounting unit mounts the elongate member on the saddle.

20 Claims, 2 Drawing Sheets

ADJUSTABLE STIRRUP BAR

FIELD OF THE INVENTION

This invention relates to an adjustable stirrup bar for a saddle and, more particularly, to an improved adjustable stirrup bar wherein the stirrup hanger can be locked in any desired position within its range of travel.

BACKGROUND OF THE INVENTION

In one conventional adjustable stirrup bar, a stirrup hanger is slidably attached to an elongate bar-like member. The stirrup hanger has a cylindrical portion which encircles the member and a hanger portion which extends from the cylindrical portion. At least one narrow longitudinal groove extends along the majority of the length of the bar-like member. Four shorter transverse grooves are of the same width as the longitudinal groove and intersect it. The transverse grooves are spaced evenly along the length of the member. A spring loaded ball is trapped between an interior recess in the cylindrical portion of the stirrup hanger and a groove of the bar-like member and moves with the stirrup hanger along the member. The ball moves through the longitudinal and transverse groove network, to guide the movement of the stirrup hanger on the bar-like member. When the ball is in a transverse groove, no longitudinal movement of the stirrup hanger is allowed. Thus, each of the transverse grooves defines a discrete stirrup hanger adjustment position along the length of the bar-like member.

Another conventional adjustable stirrup bar includes a bar-like member with four holes drilled in it equally spaced along its length. The stirrup hanger also has a hole drilled therethrough and is simply slid along the bar-like member until the hole in the stirrup hanger is aligned with one of the four holes in the member, and then a pin is inserted through the aligned holes to thereby lock the stirrup hanger in place.

The conventional adjustable stirrup bars described above provide only a few possible adjustment positions. Because of the physical size of the grooves or holes used in the conventional stirrup bars, the number of adjustable positions is at least limited by the ratio of the length of the bar-like member to the diameter of the holes or the width of the grooves. Further, the holes or grooves must be spaced from each other by some minimum distance dependent on the strength of the material of the bar-like member.

Applicant has recognized that, in order to accommodate the widest variety of individuals, a stirrup bar which is not limited to a fixed, predetermined number of adjustment positions is desirable. With such a stirrup bar, individuals may select their own adjustment position. However, applicant has also recognized that an individual may become frustrated if the stirrup hangers must be adjusted by trial and error to a preferred position, because someone else has recently adjusted the stirrup bars to a different position. Thus, applicant has recognized that an adjustable stirrup bar which allows a previous stirrup hanger position to be quickly and easily relocated, even after intervening positioning has occurred, is desirable.

Another problem with the conventional grooved stirrup bar discussed above is the tendency of the trapped ball to become dislodged from between the stirrup hanger and the grooves due to use of the stirrup bar. Although the conventional pin-type stirrup bar described above avoids that problem, the pin may be lost due to use.

Accordingly, it is an object of the present invention to provide an adjustable stirrup bar in which the parts providing adjustability are captive and so can't be lost.

It is a further object of the present invention to provide an adjustable stirrup bar, as aforesaid, which provides a continuous adjustability within the normal range of adjustability.

It is a further object of the present invention to provide an adjustable stirrup bar, as aforesaid, which enables users to select their own unique adjustment positions.

It is a further object of the present invention to provide an adjustable stirrup bar, as aforesaid, which provides the capability for quickly and easily adjusting the stirrup hanger to a previously preferred position, after the stirrup hanger has been moved to a different position.

It is a further object of the invention to provide an adjustable stirrup bar, as aforesaid, which is of simple, economical construction and which is easily maintainable.

SUMMARY OF THE INVENTION

The objects and purposes of the invention, including those set forth above, are met by providing an adjustable stirrup bar including an elongate member having a stirrup hanger mounted thereon. The stirrup hanger is provided for hanging a stirrup strap therefrom. The stirrup hanger is continuously adjustably positionable on the elongate member to any of an infinite number of alternate locations. Mounting structure is useable to attach the elongate member to the saddle tree (frame).

BRIEF DESCRIPTION OF THE DRAWINGS

An exemplary embodiment of the invention will be described in detail hereinafter in connection with the drawings, in which.

DETAILED DESCRIPTION

Figure 1:
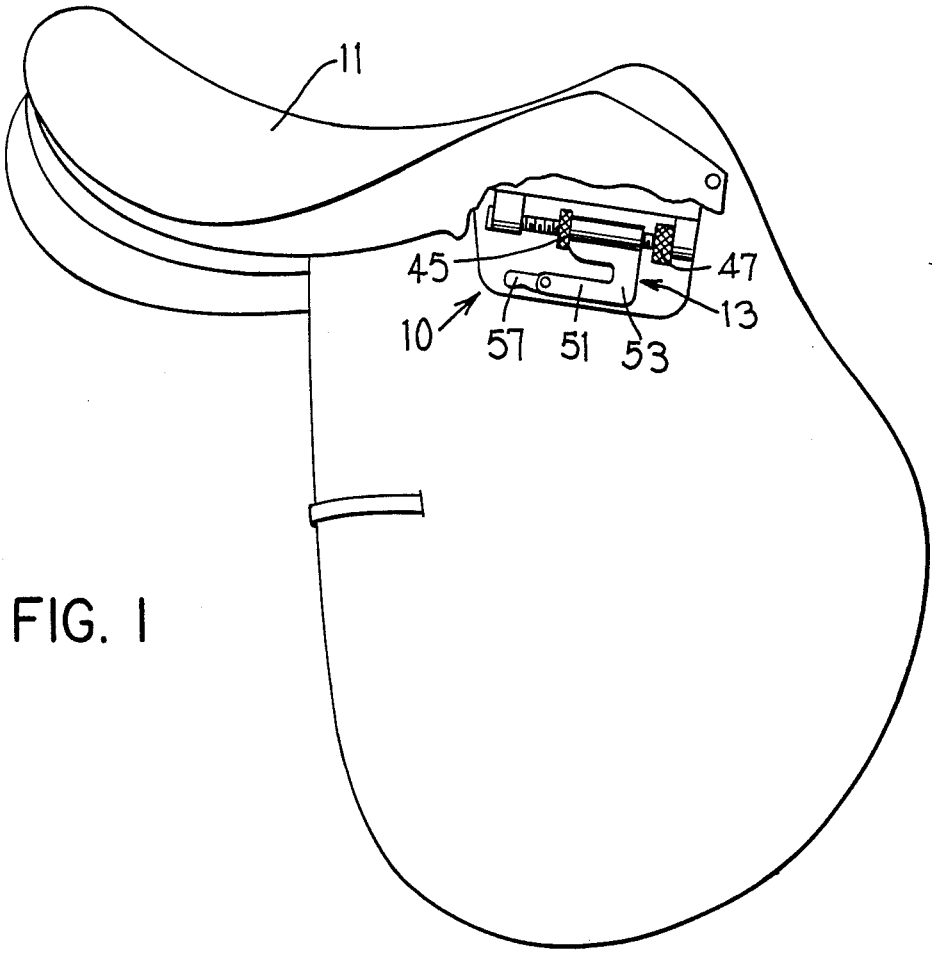
FIG. 1 is a partially broken side elevational view of a saddle carrying an adjustable stirrup bar embodying the invention.

An adjustable stirrup bar 10 embodying the present invention is shown attached to a saddle 11 in FIG. 1, and includes a stirrup hanger 13 for supporting a conventional stirrup strap SS.

Figure 2:
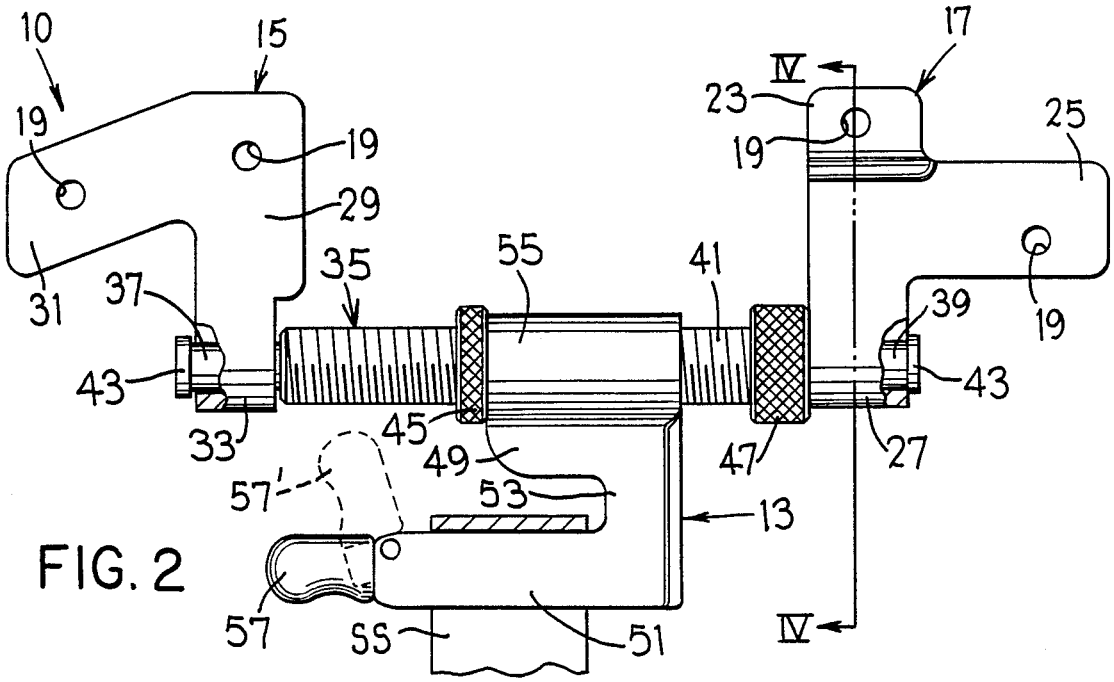
FIG. 2 is an enlarged side elevational view of the adjustable stirrup bar of FIG. 1.
Figure 4:
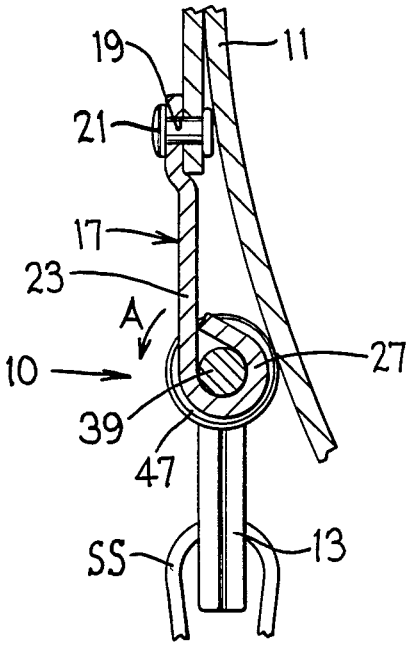
FIG. 4 is a fragmentary sectional view substantially as taken along the line IV—IV of FIG. 2.

Referring to FIGS. 2 and 4, the stirrup bar 10 includes mounting brackets 15 and 17 for prudently mounting same on the saddle 11.

The mounting bracket 17 (FIG. 2) is here a T-shaped plate-like member including a vertical leg 23. A leg 25 extends rightward from the central portion of the vertical leg 23. Mounting holes 19 pierce the free rightward end portion of the leg 25 and the upper end portion of the vertical leg 23. The lower end of the vertical leg 23 is rolled back upon itself to form a loop 27 shown in FIG. 4.

The mounting bracket 15 (FIG. 2) is here an L-shaped, plate-like member including a vertical leg 29. A leg 31 extends leftward from the upper free end of the vertical leg 29 at an angle of between 45° (downward) and 90°. A mounting hole 19 pierces the leftward free end of the leg 31. Another mounting hole 19 pierces the joinder of the legs 29 and 31. The bottom portion of the leg 29 is rolled back upon itself to form a loop 33 like the loop 27 in mounting bracket 15.

An elongate shaft 35 has ends 37 and 39 snugly but rotatably disposed within the loops 33 and 27 of the mounting brackets 15 and 17, respectively, so as to be rotatably supported thereby. The shaft 35 includes a central threaded portion 41 which is larger in diameter and substantially longer than the ends 37 and 39. Radial flanges 43 terminate the ends 37 and 39 and thus define the axial extremities of the shaft 35. The respective flanges 43 rotatably abut the axially outer edges of the loops 27 and 33. The threaded portion 41 extends between the axially inner edges of the loops 27 and 33. The flanges 43 and the threaded portion 41 are of diameter too large to pass axially through the loops 27 and 33. The shaft 35 is thus axially captive with respect to the mounting brackets 15 and 17. The radial flanges can be formed by staking the free end faces of the shaft ends 37 and 39 after the brackets are slid axially thereon.

The legs 31 and 25 of the mounting brackets 15 and 17, respectively, extend axially away from the threaded portion 41 and beyond the radial flanges 43. In this embodiment, the legs 29 and 23 of the mounting brackets 15 and 17, respectively, extend tangentially up from the ends and 39, respectively, remote from the saddle 11, as seen in FIG. 4.

The mounting holes 19 in the mounting brackets 15 and 17, when aligned with appropriate holes in the saddle 11, allow the stirrup bar 10 to be fastened to the saddle II using suitable fastening means such as rivet 21 (FIG. 4). It will be understood that a mirror-image of the stirrup bar 10 described herein is mounted on the opposite side of the saddle 11, i.e. the side not shown in FIG. 1.

A lock-nut 45 is threaded on the threaded portion 41 of the shaft 35 A radially enlarged head is fixed on the shaft at the rightward end of the threaded portion 41 for manually rotating the shaft 35. In the embodiment shown, the head is formed by a thumb-nut 47 fixed by adhesive bonding, staking, or other desired means on the right end of the threaded portion 41 adjacent the axially inner edge of the loop 27 of the mounting bracket 17. The periphery of the lock-nut 45 and thumb-nut 47 are machined (e.g. knurled) to facilitate gripping by the user.

The stirrup hanger 13 (FIG. 2) is essentially U-shaped, having two horizontal, plate-like legs 49 and 51 separated by a bight 53. The upper leg 49 is shorter than the lower leg 51. A horizontal cylindrical sleeve 55 is fixed to upper edge of the upper leg 49, as by welding. The length of the sleeve 55 exceeds its diameter, preferably by a factor of at least two, but the sleeve 55 is substantially shorter (e.g. a half or a third the length) than the threaded portion 41.

The sleeve 55 is internally threaded and is threaded onto the threaded portion 41 of the shaft 35, axially between the lock-nut 45 and thumb-nut 47. Thus, as shown in FIG. 2, the leg 49, bight 53 and leg 51 depend from the sleeve 55 threaded on the shaft 35, the leg 51 being parallel to the shaft 35. A conventional stirrup strap SS normally will hang from the lower leg 51 of the stirrup hanger 13 in a conventional manner.

The stirrup hanger 13 is, in this embodiment, forged steel. The mounting brackets 15 and 17, the elongate cylindrical member 35, the thumb-nut 47 and the lock-nut 45 are stainless steel in this embodiment.

A conventional, spring loaded safety catch 57 (FIG. 2) is pivoted at the free end of the leg 51 remote from the bight 53. The catch 57 is pivotable from its leftward extending, open, solid line position upward through approximately 90° to its upward extending, closed, dotted line position parallel to the bight 53 and toward the shaft 35. The catch 57 is spring loaded by resilient means not shown in its solid line and broken line positions 57 and 57'. The safety catch 57 is approximately the same length as the bight 53. The safety catch 57 is conventional, and further discussion of its construction is unnecessary. The catch 57 in its upper broken line position holds the stirrup strap SS on the lower leg 51. An excessive rearward force exerted by the stirrup strap will overcome the resilient bias on the upward extending catch and pivot it down to its horizontal position at 57 in FIG. 2, to allow the stirrup strap to escape leftwardly from the stirrup hanger 13, in a conventional way. On the other hand, intentional manual pivoting of the catch 57 permits installation and removal of the stirrup strap SS with respect to the stirrup hanger 13 in a conventional way.

OPERATION

The operation of the inventive apparatus will be apparent to persons acquainted with apparatus of this general type, from the above description, but will be summarized briefly below for convenient reference.

The adjustable stirrup bar 10 is fixed to the saddle tree (frame), during manufacture or rebuilding of the saddle, by means of the fasteners 21 (FIG. 4) as above described.

Each stirrup bar 10 receives, and interacts with, a stirrup strap SS as above discussed.

Figure 3:
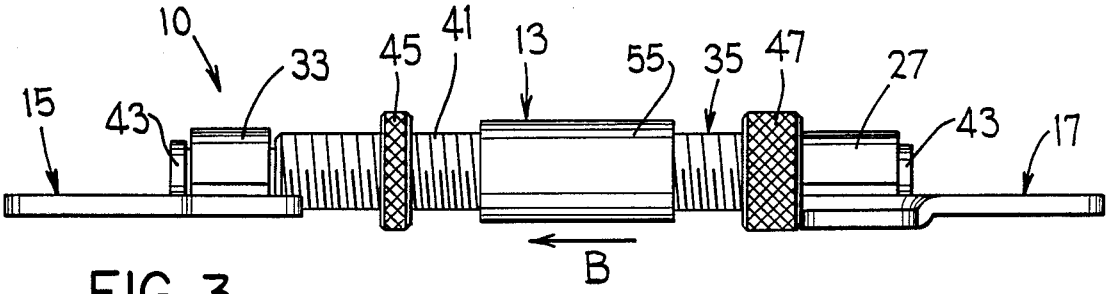
FIG. 3 is a top view of the stirrup bar of FIG. 2.

To adjust the fore-aft position of the stirrup bar 10 with respect to the saddle 11, the lock-nut 45 is rotated to travel along the threaded portion 41 away from the stirrup hanger 13. Thereafter, the thumb-nut 47 is rotated to thereby rotate the shaft 35 relative to the stirrup hanger 13. This axially moves the stirrup hanger 13 toward one or the other of the shaft ends 37 and 39, according to the direction of rotation of the thumb-nut 47. As shown in FIGS. 3 and 4, in this embodiment, rotation of the thumb-nut 47 in the direction A will cause the stirrup hanger 13 to travel in the direction B. Of course, rotation of the thumb-nut 47 in a direction opposite A will cause the stirrup hanger 13 to travel in a direction opposite B. The rotation of the thumb-nut 47 is continued until the stirrup hanger 13 reaches the desired axial position on the shaft 35.

With the stirrup hanger 13 in the desired adjustment position, the lock-nut 45 is rotated relative to the shaft 35 to travel along the threaded portion 41 toward the stirrup hanger 13. When the lock-nut 45 reaches the stirrup hanger 13, it is further rotated to achieve a snug abutting relationship with the stirrup hanger 13. This locks the stirrup hanger 13 fixedly to the shaft 35. Thus, in this locked position, any rotation of the thumb-nut 47 will merely cause the stirrup hanger 13 to attempt to rotate along with the shaft 35, so that the stirrup hanger 13 cannot travel axially along the shaft 35.

When a new adjustment position of the stirrup hanger 13 is desired, the lock-nut 45 is simply rotated so as to disengage it from the stirrup hanger 13, and the above procedure is repeated.

Thus, the inventive adjustable stirrup bar allows the stirrup hanger 13 to be positioned at any location on the threaded portion 41. The stirrup hanger 13 can then be locked at the chosen location against further axial movement on the threaded portion 41.

The present invention also allows quick and precise positioning of the stirrup hanger 13 on the shaft 35. Because the stirrup hanger 13 moves axially a fixed distance corresponding to each full revolution of the thumb nut 47, a desired position can be precisely recorded by simply noting the number of revolutions required to move the stirrup hanger 13 from the desired position to a reference position, for example, abutting the thumb-nut 47. Now, the desired positioning is easily achieved at any time by starting the stirrup hanger 13 from the reference position abutting the thumb-nut 47, rotating the thumb-nut 47 the required number of revolutions, and locking the stirrup hanger as above. Thus, a desired position need only be found once by experimentation, because it can be found thereafter as described above.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An adjustable stirrup bar for a saddle, comprising:
an elongate member having first and second ends;
a stirrup hanger having means for hanging a stirrup strap therefrom, and means mounting said stirrup hanger on said elongate member for continuous adjustment along the length of said elongate member through an infinite number of use locations within a fixed range of travel between said first and second ends;
locking means for releasably locking said stirrup hanger at any desired one of said infinite number of use locations on said elongate member within said range of travel; and
mounting means for attaching said elongate member to a saddle.

2. An adjustable stirrup bar according to claim 1, wherein said elongate member is a shaft, said mounting means including first and second plate-like mounting brackets pendently supporting said first and second ends of said shaft for free rotation of said shaft with respect to said brackets, and means on said brackets for fixing same to the saddle.

3. An adjustable stirrup bar according to claim 2, wherein said brackets have bottom portions wrapped around said first and second ends of said shaft to form rotational bearings for said shaft ends, said shaft ends terminating in radial flanges, said shaft having a threaded portion between said ends, said shaft ends being of diameter smaller than said flanges and threaded portion, said wrapped bottom portions of said brackets being axially trapped between said threaded portion and respective ones of said flanges.

4. An adjustable stirrup bar according to claim 1, wherein said elongate member is a shaft having a threaded portion between said first and second ends, and said stirrup hanger is threadedly telescoped on said threaded portion of said shaft.

5. An adjustable stirrup bar according to claim 4, wherein said locking means includes a lock-nut threaded on said threaded portion of said shaft, said lock-nut being rotatable on said shaft and thereby longitudinally movable on said shaft.

6. An adjustable stirrup bar according to claim 5, wherein said lock-nut has means snugly engagable in abutting relationship with an end of said stirrup hanger for locking said stirrup hanger longitudinally on said shaft at said desired use location.

7. An adjustable stirrup bar according to claim 1, including transport means cooperable with said stirrup hanger for moving said stirrup hanger longitudinally on said elongate member.

8. An adjustable stirrup bar according to claim 7, in which said transport means is mounted on said elongate member.

9. An adjustable stirrup bar according to claim 8, wherein said elongate member is a shaft and includes a threaded portion between said first and second ends.

10. An adjustable stirrup bar according to claim 9, wherein said stirrup hanger is threadedly telescoped on said threaded portion of said shaft.

11. An adjustable stirrup bar according to claim 10, wherein said locking means includes a lock-nut threadedly telescoped on said threaded portion of said shaft, said lock-nut being rotatable relative to said shaft for movement longitudinally on said shaft.

12. An adjustable stirrup bar according to claim 11, wherein said lock-nut includes means snugly engagable in abutting relationship with said stirrup hanger for locking said stirrup hanger on said shaft.

13. An adjustable stirrup bar according to claim 8, wherein said elongate member is a shaft and said transport means includes rotation means for effecting relative rotation of said stirrup hanger and said shaft.

14. An adjustable stirrup bar according to claim 13, wherein said shaft is rotatably supported by said mounting means.

15. An adjustable stirrup bar according to claim 14, wherein said rotation means includes a manually rotatable thumb-nut fixed to said shaft.

16. An adjustable stirrup bar for a saddle, comprising:
an elongate member having first and second ends;
a stirrup hanger having means for hanging a stirrup strap therefrom, said stirrup hanger being mounted on said elongate member;
transport means cooperable with said elongate member and stirrup hanger and rotatable with respect to said stirrup hanger for moving said stirrup hanger longitudinally along said elongate member; and
mounting means for attaching said elongate member to a saddle.

17. An adjustable stirrup bar according to claim 16, wherein said elongate member is a shaft and includes a threaded portion between said first and second ends, said stirrup hanger being threadedly telescoped on said threaded portion of said shaft.

18. An adjustable stirrup bar according to claim 17, wherein said transport means includes rotation means for effecting relative rotation of said stirrup hanger and said shaft and therewith for axially shifting said stirrup hanger along said shaft.

19. An adjustable stirrup bar according to claim 18, wherein said shaft is rotatably supported by said mounting means.

20. An adjustable stirrup bar according to claim 19, wherein said rotation means includes a manually actuable thumb-nut fixedly attached to said shaft.

* * * * *